US010433600B2

(12) United States Patent
Emoff

(10) Patent No.: US 10,433,600 B2
(45) Date of Patent: Oct. 8, 2019

(54) GARMENT FOR PERSONS WITH PHYSICAL DISABILITIES

(71) Applicant: Shumsky Therapeutic Pillows, LLC, Dayton, OH (US)

(72) Inventor: Michael J. Emoff, Dayton, OH (US)

(73) Assignee: Shumsky Therapeutic Pillows, LLC, Dayton, OH (US)

( * ) Notice: Subject to any disclaimer, the term of this patent is extended or adjusted under 35 U.S.C. 154(b) by 183 days.

(21) Appl. No.: 15/591,462

(22) Filed: May 10, 2017

(65) Prior Publication Data

US 2018/0325195 A1 Nov. 15, 2018

(51) Int. Cl.

| | |
|---|---|
| ***A41D 27/24*** | (2006.01) |
| ***A41B 1/10*** | (2006.01) |
| ***A41B 9/06*** | (2006.01) |
| ***A41D 1/18*** | (2006.01) |
| ***A41D 1/22*** | (2018.01) |
| ***A41D 13/12*** | (2006.01) |
| ***A41D 3/00*** | (2006.01) |
| ***A41F 1/00*** | (2006.01) |

(52) U.S. Cl.

CPC ..... *A41D 27/24* (2013.01); *A41B 1/10* (2013.01); *A41B 9/06* (2013.01); *A41D 1/18* (2013.01); *A41D 1/22* (2013.01); *A41D 3/00* (2013.01); *A41D 13/129* (2013.01); *A41D 13/1236* (2013.01); *A41D 13/1245* (2013.01); *A41F 1/002* (2013.01); *A41B 2400/44* (2013.01); *A41B 2400/70* (2013.01); *A41D 2300/32* (2013.01); *A41D 2400/44* (2013.01); *A41D 2400/70* (2013.01)

(58) Field of Classification Search

CPC .. A41D 27/24; A41B 1/10; A41B 9/06; A41B 1/18; A41B 1/22; A41B 3/00

See application file for complete search history.

(56) References Cited

U.S. PATENT DOCUMENTS

| | | | | |
|---|---|---|---|---|
| 4,258,440 | A * | 3/1981 | McGowan | A41D 13/1236 2/114 |
| 4,300,568 | A * | 11/1981 | Blanckmeister | A41F 1/006 450/85 |
| 4,422,186 | A * | 12/1983 | Loney | A41D 13/129 2/114 |
| 4,686,715 | A * | 8/1987 | Price | A41D 13/129 2/114 |
| 4,759,083 | A * | 7/1988 | Belcher | A41D 13/1236 2/114 |
| 4,879,766 | A * | 11/1989 | Hull | A41C 3/00 2/101 |
| 4,917,651 | A * | 4/1990 | Rainville | A41C 3/02 2/101 |
| 5,097,535 | A | 3/1992 | Dye et al. | |
| 5,398,343 | A | 3/1995 | Kuracina | |
| 5,564,123 | A | 10/1996 | Grassick | |
| 5,829,059 | A | 11/1998 | Covington, Jr. | |

(Continued)

*Primary Examiner* — Richale L Quinn

(74) *Attorney, Agent, or Firm* — Walter & Wasylyna LLC

(57) ABSTRACT

A garment includes a front and a back. The garment also includes an openable seam separating the front and the back and a releasable closure to secure the openable seam together. The garment also includes a closing feature to draw the front and the back together and engage the releasable closure to enclose the openable seam.

20 Claims, 13 Drawing Sheets

(56) References Cited

U.S. PATENT DOCUMENTS

| | | | | |
|---|---|---|---|---|
| 6,253,424 | B1 * | 7/2001 | Rainville-Lonn | A41C 3/02 24/306 |
| 7,454,798 | B2 * | 11/2008 | Feodoroff | A41D 13/1245 2/114 |
| 9,089,174 | B1 * | 7/2015 | Michaelis | A41D 13/0015 |
| 9,655,385 | B2 * | 5/2017 | Marino | A41B 1/08 |
| 9,999,265 | B2 * | 6/2018 | Monardo | A41D 13/1236 |
| 2001/0054192 | A1 * | 12/2001 | Haar | A41D 11/00 2/69 |
| 2002/0152535 | A1 * | 10/2002 | Gaza | A41D 13/1236 2/114 |
| 2010/0125930 | A1 * | 5/2010 | Burrell, IV | A41B 13/08 2/75 |
| 2013/0067633 | A1 * | 3/2013 | Salem | A41D 13/1245 2/102 |
| 2014/0026289 | A1 | 1/2014 | Schulties | |
| 2014/0189931 | A1 * | 7/2014 | Fredrickson | A41D 13/1236 2/114 |
| 2015/0181953 | A1 * | 7/2015 | Brown | A41D 11/00 2/69 |
| 2017/0231798 | A1 * | 8/2017 | Shin | A61F 5/02 2/44 |
| 2018/0064184 | A1 * | 3/2018 | Kuo | A41D 13/1263 |
| 2018/0132552 | A1 * | 5/2018 | Rivera | A41D 13/1236 |

* cited by examiner

GARMENT FOR PERSONS WITH PHYSICAL DISABILITIES

FIELD

The present disclosure is generally related to clothing and, more particularly, to specialized garments useful for a physically handicapped person.

BACKGROUND

People who are affected by a temporary or permanent physical disability often find it difficult to don garments of conventional design. In particular, those people who have limited use of their arms or are unable to fully fold their arms for purposes of inserting the limb into the conventional garment opening must have others assist them in dressing.

Various specialized upper garments (e.g., garments essentially covering the torso) have attempted to alleviate the difficulty of donning a conventional garment by including at least one openable seam. Such specialized upper garments typically utilize a reusable closure to secure the openable seam upon donning the garment. However, a person with limited dexterity in one arm may find it difficult to manually fasten the closure on the same side of their body as the arm with full functionality, which then still requires assistance from others.

Accordingly, those skilled in the art continue with research and development efforts directed to specialized garments for use by a physically handicapped person.

SUMMARY

In an example, the disclosed garment includes a front and a back. The garment also includes an openable seam separating the front and the back and a releasable closure to secure the openable seam together. The garment also includes a closing feature to draw the front and the back together and engage the releasable closure to enclose the openable seam.

In another example, the disclosed garment for wear by a person having one functionally limited arm and one fully functional arm includes a front and a back forming a torso section. The garment also includes an openable seam separating the front and the back along opposing shoulder regions of the torso section and a releasable closure to secure the openable seam together. The garment also includes a closing feature to draw the front and the back together and engage the releasable closure to enclose the openable seam along one of the shoulder regions associated with the fully functional arm.

In an example, the disclosed method for making a garment for wear a person having one functionally limited arm and one fully functional arm includes the steps of: (1) providing a front and a back forming a torso section, (2) forming an openable seam separating the front and the back along opposing shoulder regions of the torso section, (3) providing a releasable closure located along the openable seam to releasably secure the openable seam together, and (4) providing a closing feature located proximate to the openable seam to draw the front and the back together and engage the releasable closure to enclose the openable seam along one of the shoulder regions associated with the fully functional arm.

Other examples of the disclosed garment and methods will become apparent from the following detailed description, the accompanying drawings and the appended claims.

DETAILED DESCRIPTION

Figure 2:
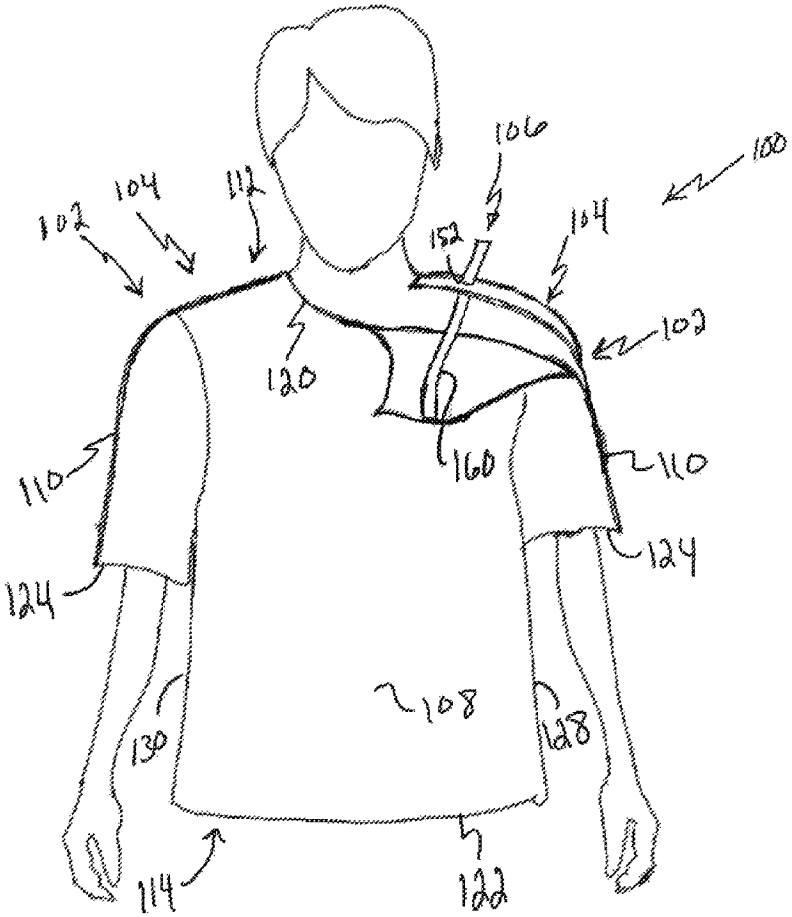
FIG. 2 is a schematic environmental front view of the example garment of FIG. 1 shown in a partially open disposition.

The following detailed description refers to the accompanying drawings, which illustrate specific embodiments and/or examples described by the disclosure. Other embodiments and/or examples having different structures and operations do not depart from the scope of the present disclosure. Like reference numerals may refer to the same feature, element or component in the different drawings.

Illustrative, non-exhaustive examples, which may be, but are not necessarily, claimed, of the subject matter according the present disclosure are provided below.

Referring generally to FIGS. 1-15, the disclosed garment 100 includes any garment for the at least the upper part of the body or that essentially covers at least the torso of the wearer. The garment 100 may be outerwear or an undergarment (e.g., an undershirt). The garment 100 is generally shown and described in the illustrative examples as a shirt. The description provided for the illustrative examples of the disclosed garment 100 may be used on short sleeve, long sleeve or sleeveless pullover shirts, such as a t-shirt or a collared shirt with buttons (e.g., a polo or golf shirt) or short sleeve or long sleeve front-opening shirts (e.g., a dress shirt). In other general examples, the garment 100 may be a blouse, a dress, a jacket, a hospital gown and the like. The particular size and shape requirements of the garment 100 may be dictated by clothing style and clothing size considerations.

Depending upon the style, the garment 100 may be manufactured in several portions or sections that are then assembled together or may be manufactured as a single unit. The garment 100 may be composed of various types of fabric material known in the art for making upper garments, for example, cotton, polyester, silk, rayon and the like or combinations and blends thereof. Additionally, the garment 100 may be treated with various types of agents and compounds, for example, to retain heat, wick moisture, remain dry, control odor and the like. Further, the garment 100 may include different indicia (e.g., company or team logos, advertisements, names, etc.) applied to one or more inner or outer surface.

For the sake of clarity, it should be noted that the examples described herein reference different locations, portions or areas of the garment 100 as if a person were wearing the garment 100. As an example, the "inside" of the garment 100 refers to the internal surface of the garment 100 that would touch the wearer's skin when the garment 100 is on. Conversely, the "outside" of the garment 100 refers to the surface of the garment 100 facing away from the wearer's body. As another example, the "back" of the garment 100 refers to the side of the garment that would cover the wearer's back and would typically include a tag. Conversely, the "front" of the garment 100 refers to the side opposite the back that would cover the wearer's front. Additionally, other terms such as "right," "left," "upper," "lower" and the like refer to locations, portions or areas of the garment 100 relative to the person wearing the garment 100. As an example, the "right side" of the garment 100 refers to the side of the garment 100 located on the right side of the wearer.

Figure 1:
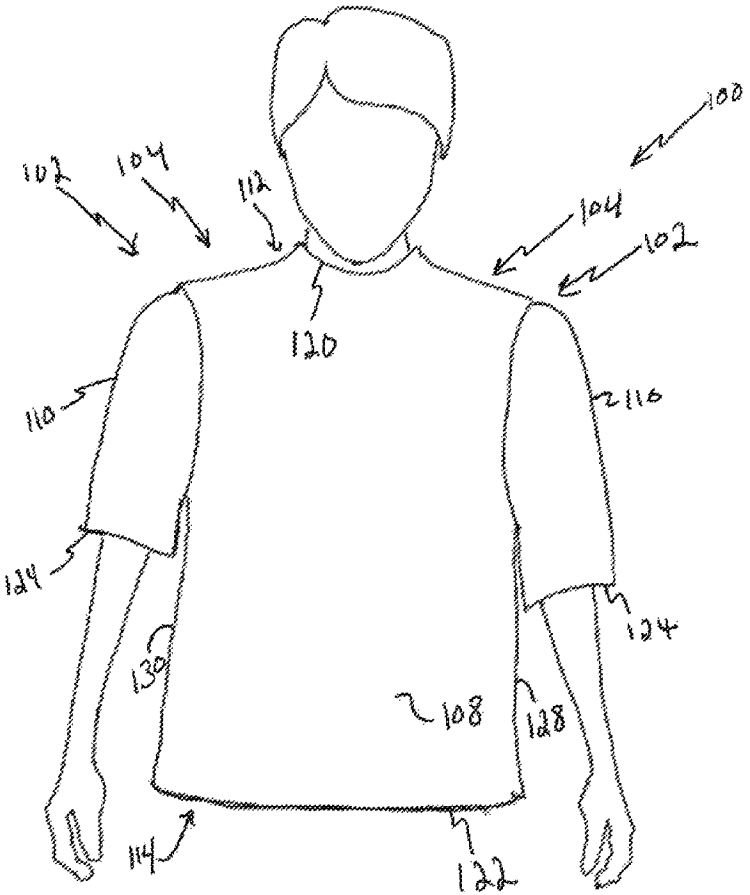
FIG. 1 is a schematic environmental front view of an example of the disclosed garment shown in a closed disposition.

Referring to FIGS. 1-2, generally, the disclosed garment 100 is directed to a specialized garment that is particularly useful for a physically handicapped person with one arm having limited functionality, dexterity, mobility and/or strength (identified generally as having limited functionality or as a functionally limited arm throughout this disclosure). The garment 100 is configured for ease of donning and removal by the wearer using only one arm having full or substantially full functionality, dexterity, mobility and/or strength (identified generally as having full functionality or as a fully functional arm throughout this disclosure) and without assistance from others.

The garment 100 is suitable for convenient and practical manipulation with only the fully functional arm by providing openable seams 102 and releasable closures 104 that secure the openable seams 102. FIG. 1 illustrates the example garment 100 in a fully closed disposition (e.g., configuration or arrangement) with the openable seams 102 secured closed by the releasable closures 104. FIG. 2 illustrates the example garment 100 in a partially open disposition (e.g., configuration or arrangement) with the openable seam 102 on a right side 130 of the garment 100 closed and the openable seam 102 on the left side 128 of the garment 100 partially open with a portion of an upper end 112 of the garment 100 folded over.

The garment 100 also includes a specialized closing feature 106 that is particularly useful to close the openable seams 102 and engage the releasable closures 104 when donning the garment 100. The closing feature 106 is operable by manipulation with the fully functional arm and is configured to bring the openable seam 102 together on the same side of the garment 100 as the fully functional arm. In the example illustrated in FIGS. 1 and 2, the right arm of the wearer has limited functionality and the left arm of the wearer has full functionality.

In an example, the disclosed garment 100 includes a torso section 108. The torso section 108 includes the upper end 112 having a neck opening 120 and a lower end 114 having a lower torso opening 122. The torso section 108 may also include a collar 126 (FIGS. 3 and 4) formed around a perimeter of the neck opening 120.

The torso section 108 includes a front 116 and a back 118 for covering the front, back and sides of the torso of the wearer. The front 116 includes the material associated with the garment 100 located on the front portion and, optionally, part of the side portions of the garment 100. The back 118 includes the material associated with the garment 100 located on the back portion and, optionally, part of the side portions of the garment 100. The back 118 may not be entirely visible in FIGS. 1 and 2.

In an example, the front 116 and the back 118 are formed from tubular body of material. In another example, the front 116 and the back 118 are formed from multiple pieces of material (e.g., a front section or panel and a back section or panel) that are joined along a common seam at the left side 128 and the right side 130 of the torso section 108. The front 116 and the back 118 may be joined through various material joining techniques known to those of ordinary skill in the art, such as sewing, gluing, fastening or any other means of joining material together.

In the illustrative examples, the garment 100 also includes a pair of sleeves 110, identified as a right (e.g., first) sleeve 110-1 and a left (e.g., second) sleeve 110-2 in FIGS. 5-11, connected to and extending from the torso section 108 and having an arm opening 124 at the end of the sleeve 110. The sleeves 110 are joined to the front 116 and the back 118 of the torso section 108. While the illustrative example of the garment 100 is shown having short sleeves, in other examples, the garment 100 may have long sleeves or may be sleeveless. The sleeves 110 may be joined to the torso section 108 through various material joining techniques known to those of ordinary skill in the art.

In examples where the garment 100 includes sleeves 110 joined to the torso section 108, the front 116 also includes the material associated with the sleeve 110 located on the front portion and, optionally, part of the side portions of the sleeve 100 and the back 118 also includes the material associated with the sleeve 110 located on the back portion and, optionally, part of the side portions of the sleeve 100.

Figure 4:
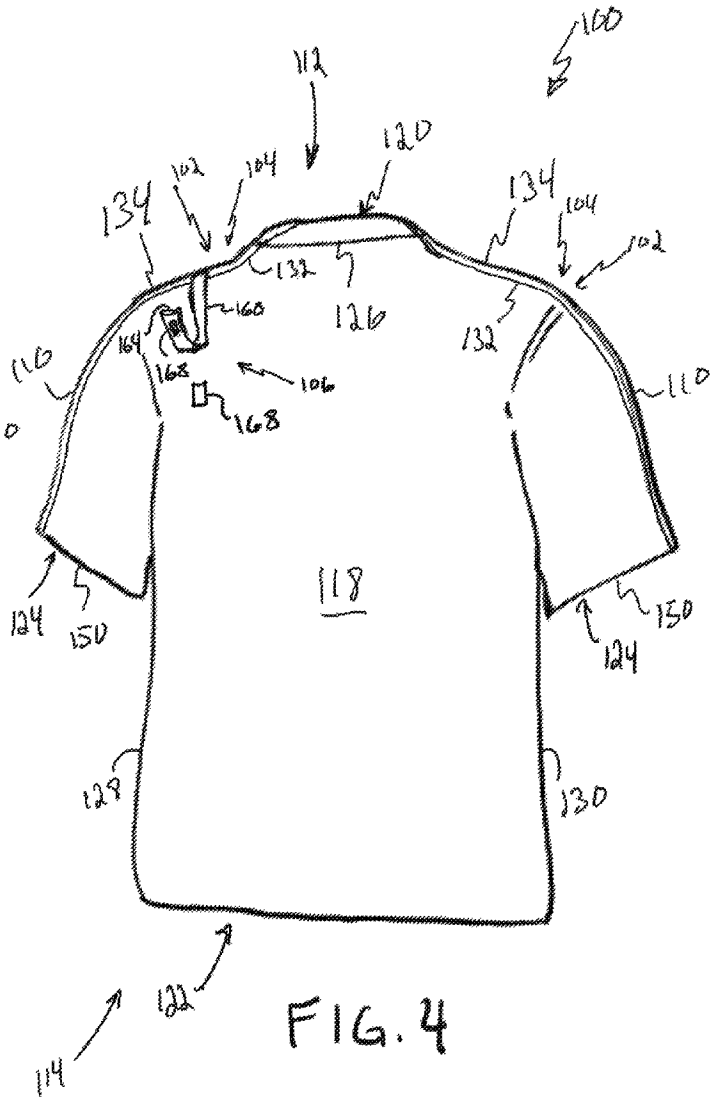
FIG. 4 is a schematic back view of the garment of FIG. 4.
Figure 3:
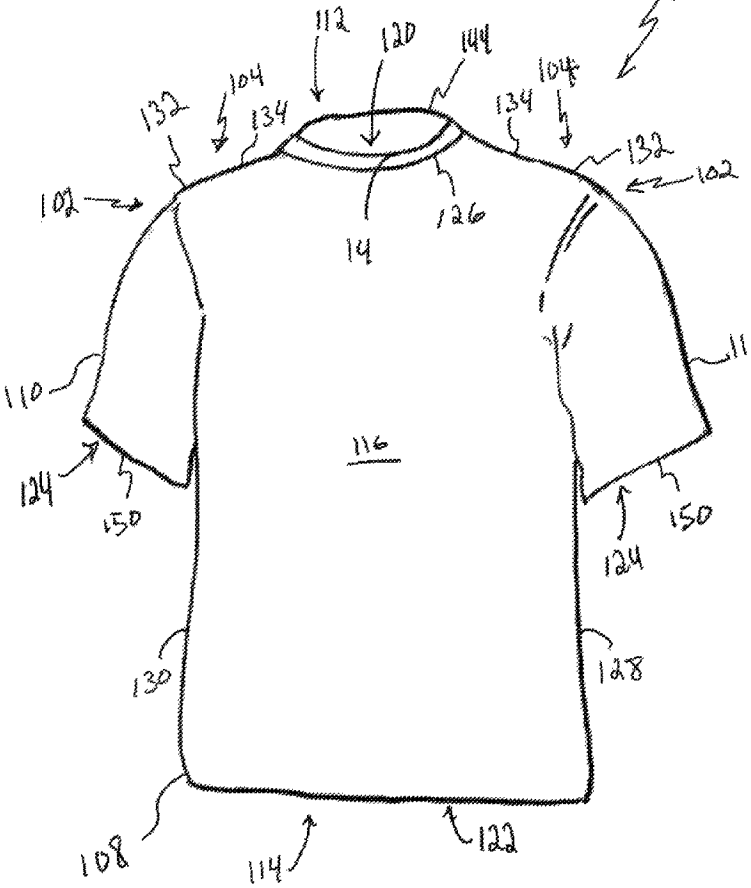
FIG. 3 is a schematic front view of another example of the disclosed garment.

Referring to FIGS. 3 and 4, in an example, the openable seams 102 and the releasable closures 104 form a line of connection 132 extending from the neck opening 120 to the arm opening 124. In examples of the garment 100 having sleeves 110, as illustrated in FIGS. 3 and 4, the line of connection 132 extends from the neck opening 120 of the torso section 108 along a shoulder region 134 of the torso section 108 and along the sleeve 110 to the arm opening 124 at the end of the sleeve 110. In examples of the garment 100 having no sleeves (not illustrated), the line of connection 132 extends from the neck opening 120 of the torso section 108 along the shoulder region 134 of the torso section 108 to the arm opening 124 formed at a side of the upper end 112 of the torso section 108. In examples of the garment 100 having the collar 126, the line of connection 132 extends from the neck opening 120 of the torso section 108 through the collar 126 and to the shoulder region 134 of the torso section 108.

The line of connection 132 is located and constructed to provide an appearance resembling a standard garment as closely as possible. As an example, the line of connection 132 formed by the openable seams 102 and the releasable closures 104 may resemble a conventional seam extending along the shoulder region and, optionally, the sleeves, of the standard garment.

Figure 5:
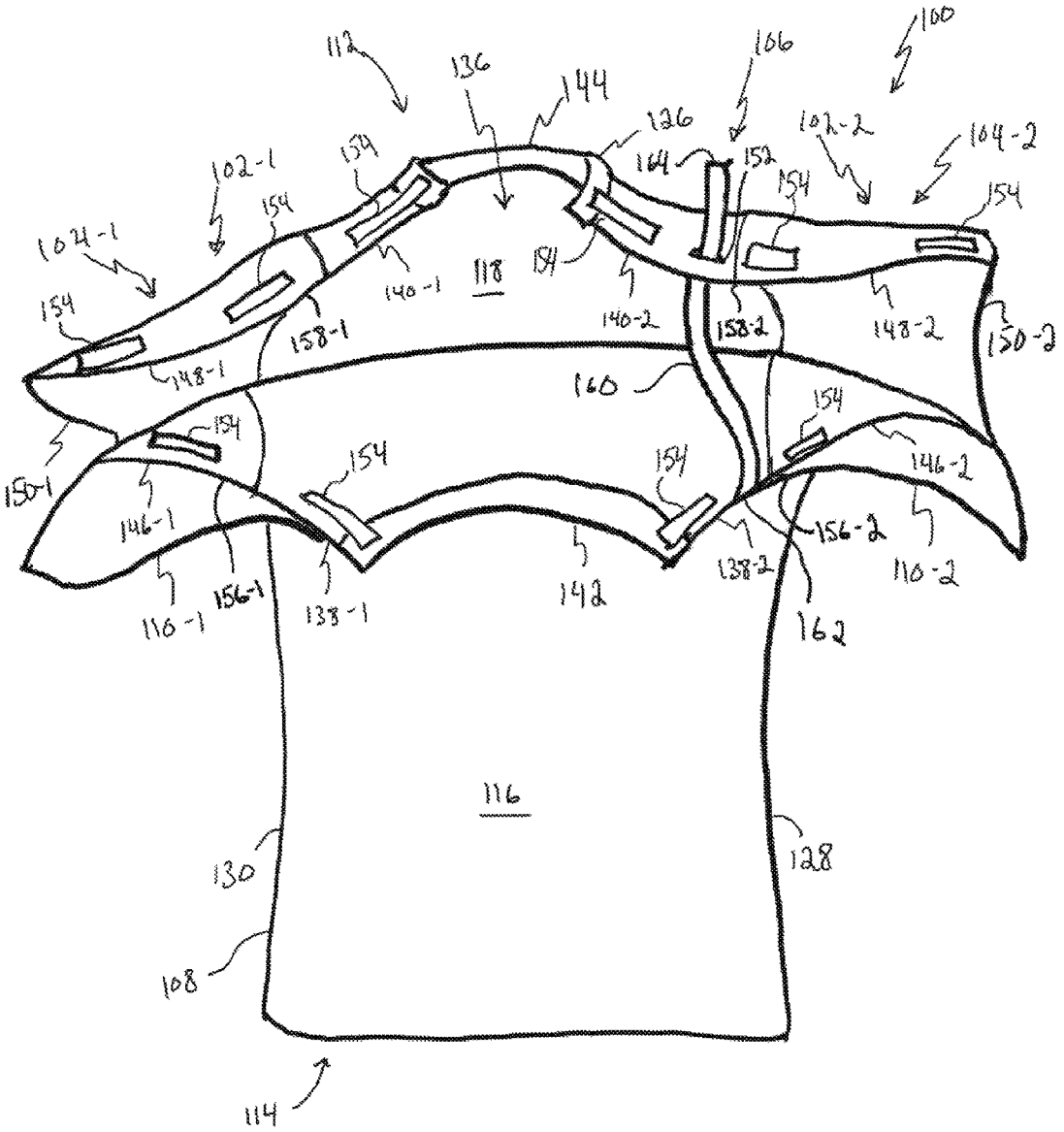
FIG. 5 is a schematic front view of another example of the disclosed garment shown in an open disposition.
Figure 6:
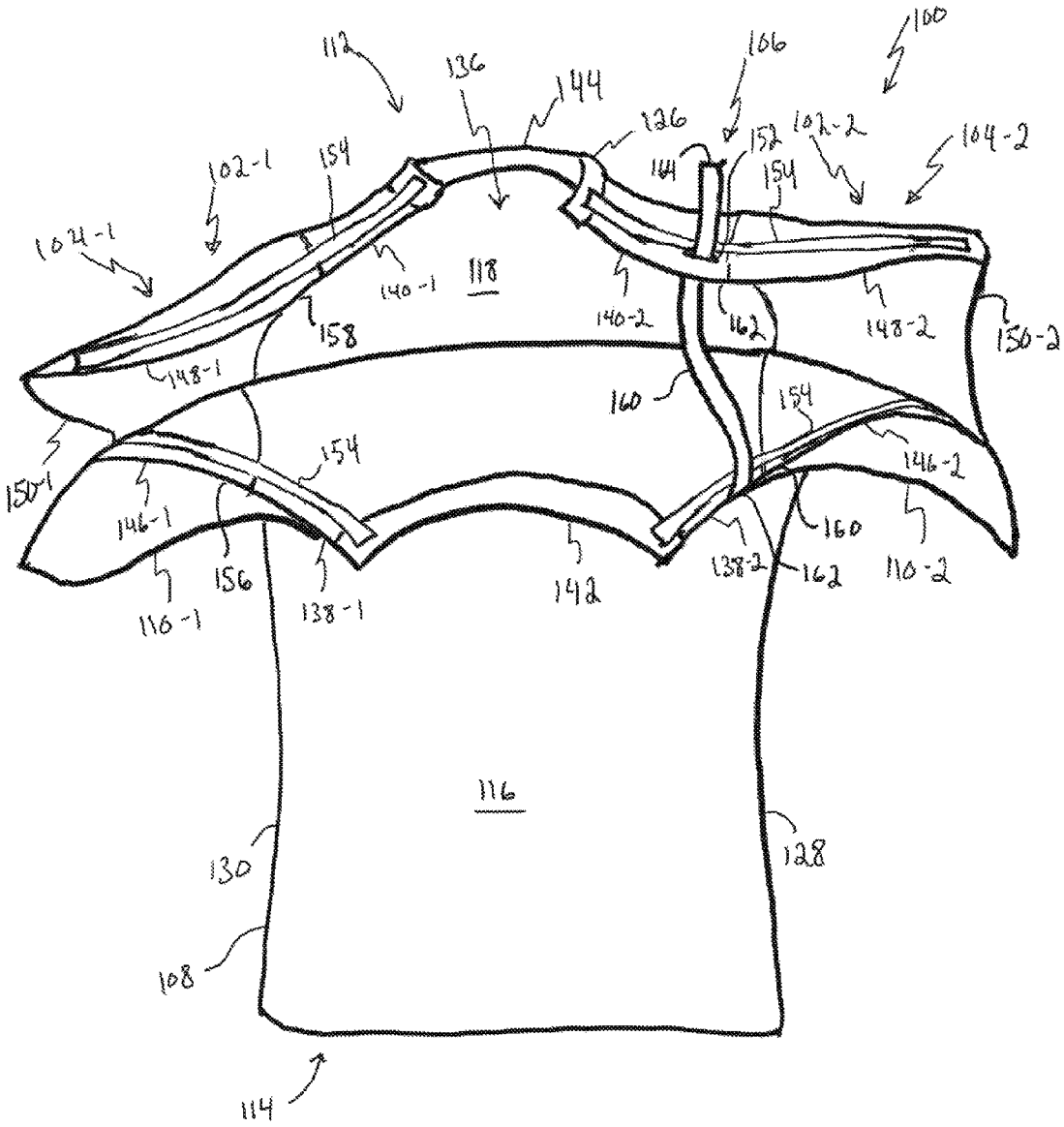
FIG. 6 is a schematic front view of another example of the disclosed garment shown in an open disposition.

FIGS. 5 and 6 illustrate examples of the garment 100 in a fully open disposition (e.g., configuration or arrangement) with a portion of the upper end 112 of the front 116 folded over for clarity. As illustrated in FIG. 5, a right (e.g., first) openable seam 102-1 and a left (e.g., second) openable seam 102-2 are separated to create an upper torso opening 136 in the upper end 112 of the torso section 108.

Referring to FIGS. 5 and 6, in an example, an upper portion of the front 116 of the torso section includes a right-front (e.g., first) shoulder edge 138-1 and a left-front (e.g., second) shoulder edge 138-2. The right-front shoulder edge 138-1 and the left-front shoulder edge 138-2 are separated by a front neck opening edge 142 forming a front portion of the neck opening 120.

An upper portion of the back 118 of the torso section 108 includes a right-back (e.g., first) shoulder edge 140-1 and a left-back (e.g., second) shoulder edge 140-2. The right-back shoulder edge 140-1 and the left-back shoulder edge 140-2 are separated by a back neck opening edge 144 forming a back portion of the neck opening 120. The right-back shoulder edge 140-1 is opposite the right-front shoulder edge 138-1 and the left-back shoulder edge 140-2 is opposite the left-front shoulder edge 138-2.

In an example, an upper portion of the right sleeve 110-1 includes a right-front (e.g., first) sleeve edge 146-1 and right-back (e.g., second) sleeve edge 148-1. An upper portion of the left sleeve 110-2 includes a left-front (e.g., first) sleeve edge 146-2 and a left-back (e.g., second) sleeve edge 148-2.

In an example, the right-back shoulder edge 140-1 and the right-back sleeve edge 148-1 form a continuous edge extending from a right side of the back neck opening edge 144 to a right arm opening edge 150-1. The right-front shoulder edge 138-1 and the right-front sleeve edge 146-1 form a continuous edge extending from a right side of the front neck opening edge 142 to the right arm opening edge 150-1.

Similarly, in an example, the left-back shoulder edge 140-2 and the left-back sleeve edge 148-2 form a continuous edge extending from a left side of the back neck opening edge 144 to a left arm opening edge 150-2. The left-front shoulder edge 138-2 and the left-front sleeve edge 146-2 form a continuous edge extending from a left side of the front neck opening edge 142 to the left arm opening edge 150-2.

In an example, the edges formed by the front shoulder edges 138, the back shoulder edges 140, the front sleeve edges 146 and the back sleeve edges 148 define opposed front edge 156 and back edge 158 of the openable seams 102. As an example, the right-front shoulder edge 138-1 and the right-front sleeve edge 146-1 define a right-front edge 156-1 of the right openable seam 102-1. The right-back shoulder edge 140-1 and the right-back sleeve edge 148-1 define the right-back edge 158-1 of the right openable seam 102-1. The left-front shoulder edge 138-2 and the left-front sleeve edge 146-2 define the left-front edge 156-2 of the left openable seam 102-2. The left-back shoulder edge 140-2 and the left-back sleeve edge 148-2 define the left-back edge 158-2 of the left openable seam 102-2.

Figure 7:
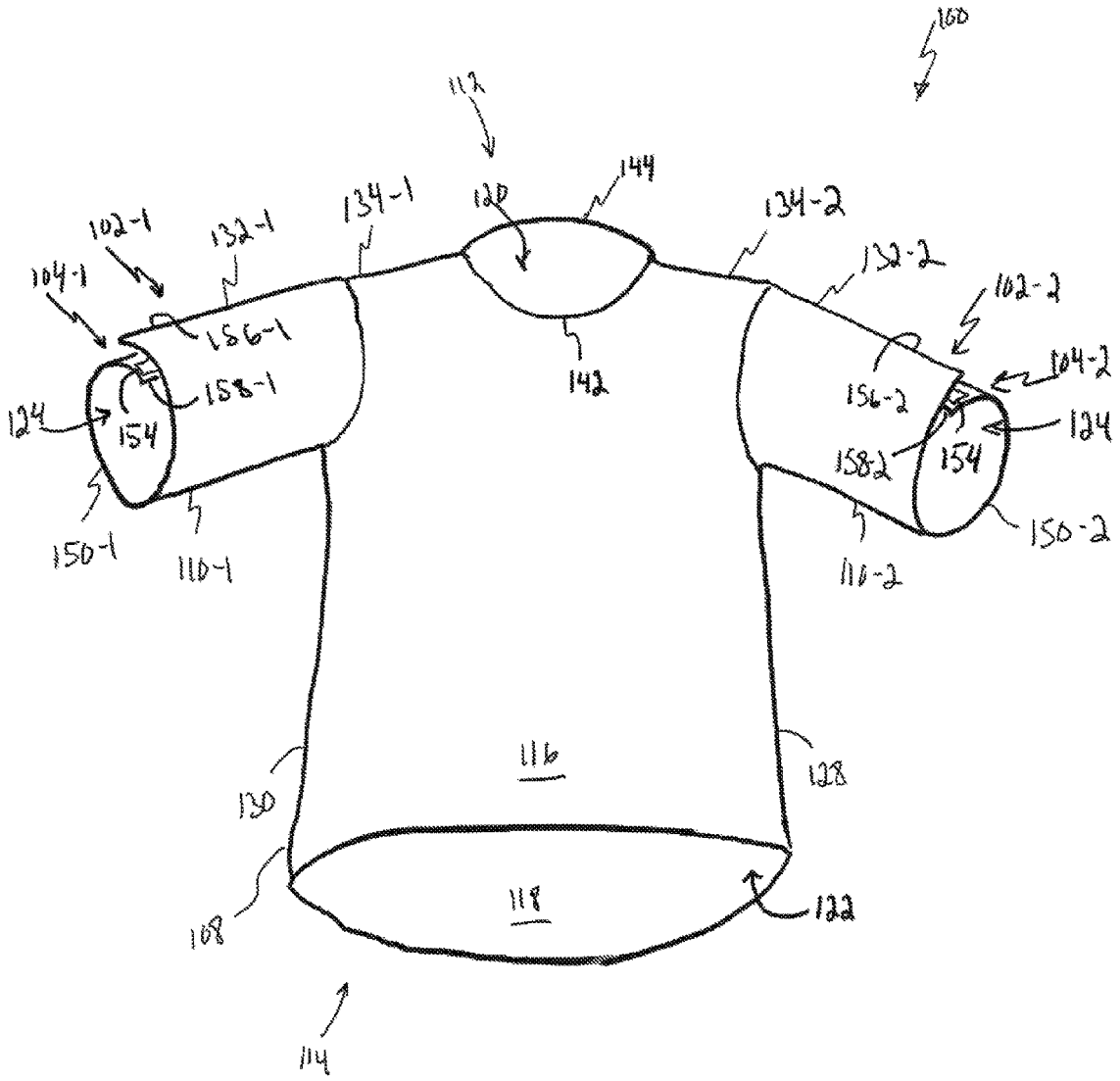
FIG. 7 is a schematic front view of another example of the disclosed garment shown in a substantially closed disposition.
Figure 8:
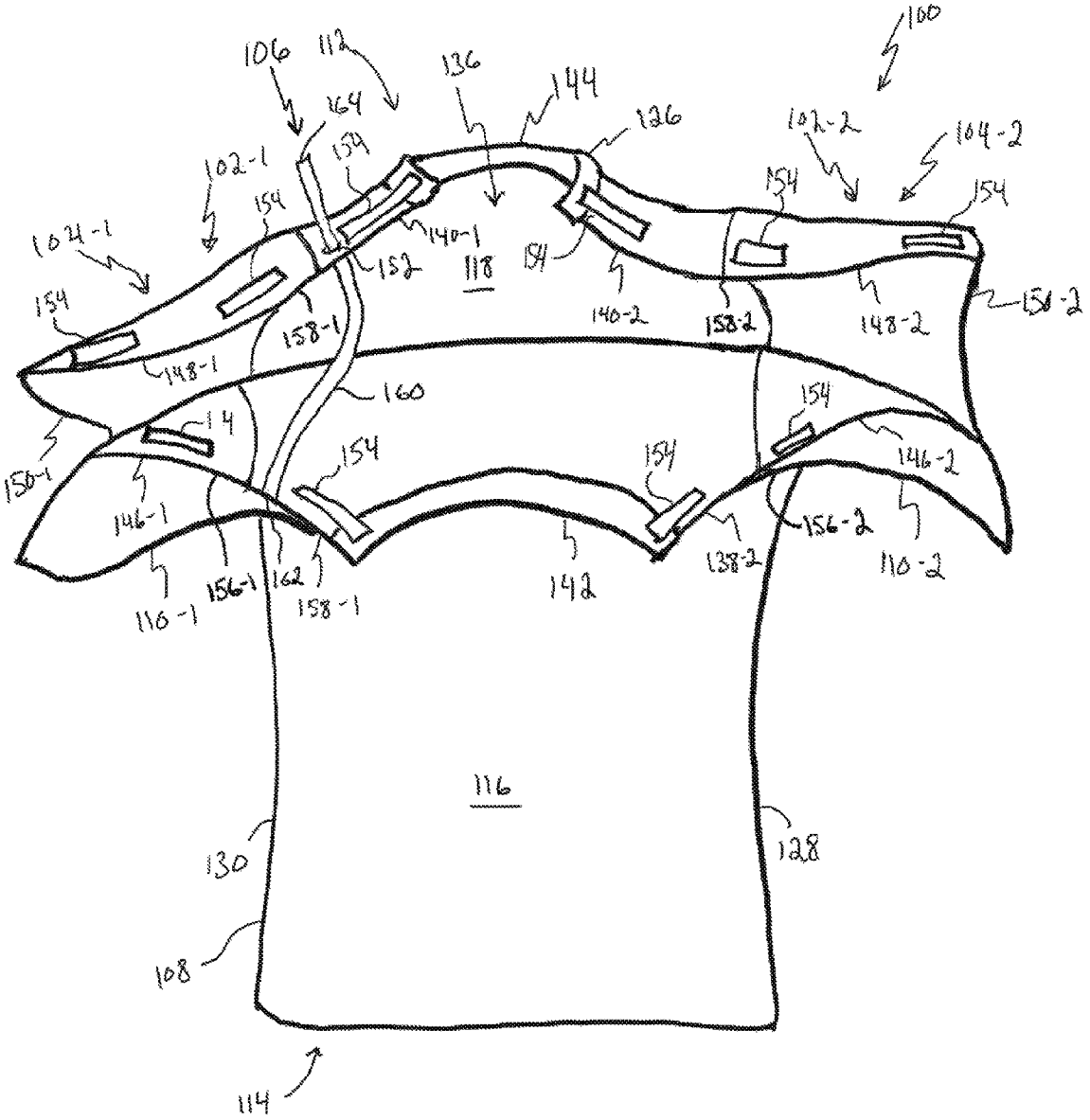
FIG. 8 is a schematic front view of another example of the disclosed garment shown in an open disposition.
Figure 9:
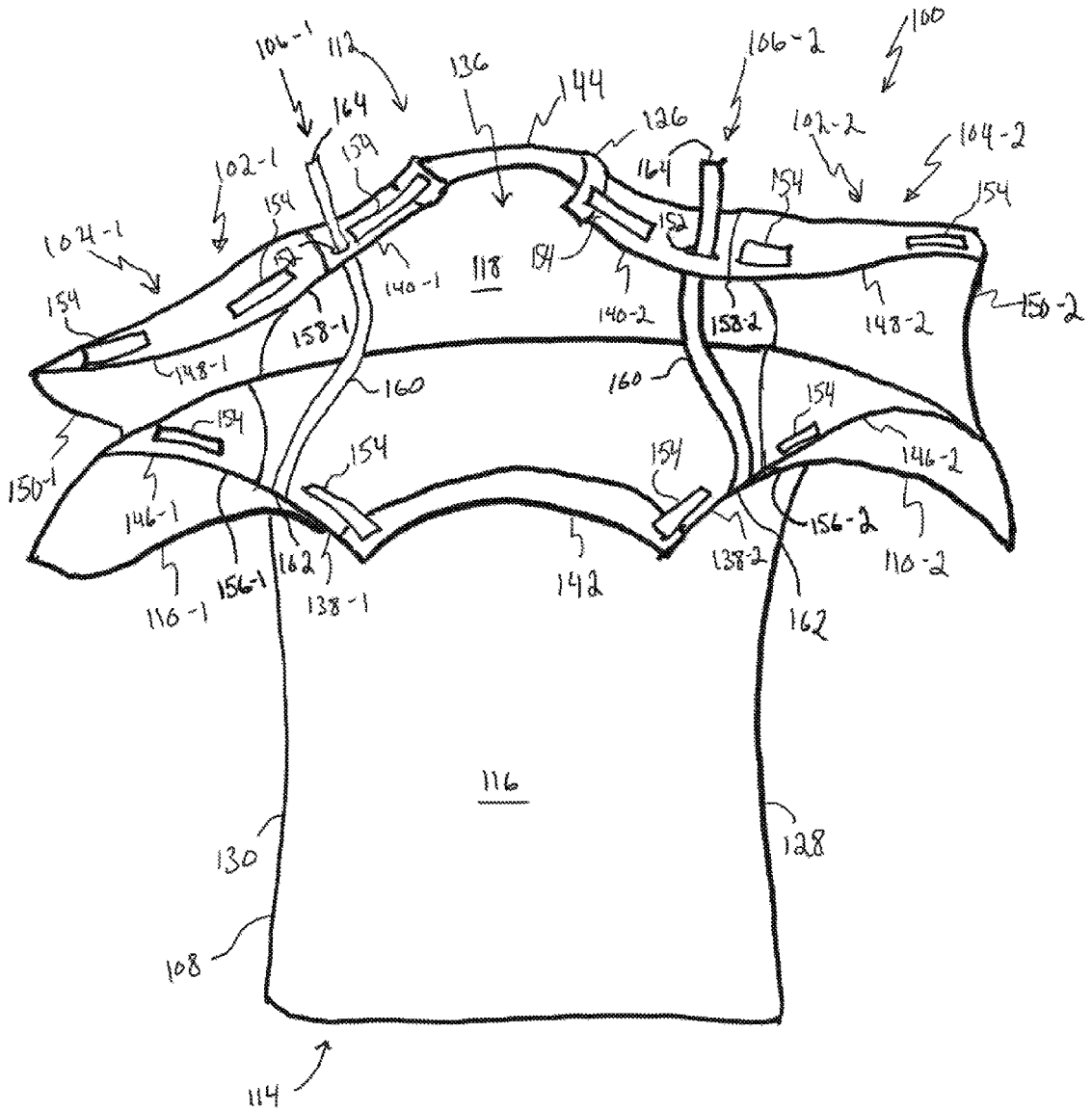
FIG. 9 is a schematic front view of another example of the disclosed garment shown in an open disposition.

In an example, the releasable closures 104 are located proximate to and extend along the opposed edges of the openable seam 102. As an example, the releasable closures 104 are located proximate to and extend along the front shoulder edges 138, the back shoulder edges 140, the front sleeve edges 146 and the back sleeve edges 148. Engagement of the releasable closures 104 closes and secures the openable seams 102 to dispose the garment 100 in the closed configuration, as illustrated in FIG. 7. Disengagement of the releasable closures 104 releases and opens the openable seams 102 to dispose the garment 100 in the open configuration and form the upper torso opening 136, as illustrated in FIGS. 5, 6 and 8-11.

In an example, the right releasable closure 104-1 is located proximate to and extends along the right-front shoulder edge 138-1 and the right-front sleeve edge 146-1 and is located proximate to and extends along the right-back shoulder edge 140-1 and the right-back sleeve edge 148-2. Engagement of the right releasable closure 104-1 closes and secures the right openable seam 102-1 to dispose a right portion of the garment 100 in the closed configuration. Disengagement of the right releasable closure 104-1 releases and opens the right openable seam 102-1 to dispose the right portion of the garment 100 in the open configuration.

Similarly, in an example, the left releasable closure 104-2 is located proximate to and extends along the right-front shoulder edge 138-1 and the right-front sleeve edge 146-1 and is located proximate to and extends along the right-back shoulder edge 140-1 and the right-back sleeve edge 148-2. Engagement of the left releasable closure 104-2 closes and secures the left openable seam 102-2 to dispose a left portion of the garment 100 in the closed configuration. Disengagement of the left releasable closure 104-2 releases and opens the left openable seam 102-2 to dispose the left portion of the garment 100 in the open configuration.

In an example, the releasable closures 104 include one or more releasable fasteners 154. As an example, a front portion of the right releasable closure 104-1 includes one or more releasable fasteners 154 located proximate to and extending along the right-front shoulder edge 138-1 and the right-front sleeve edge 146-1 between the front neck opening edge 142 and the right arm opening edge 150-1. A back portion of the right releasable closure 104-1 includes one or more releasable fasteners 154 located proximate to and extending along the right-back shoulder edge 140-1 and the right-back sleeve edge 148-1 between the back neck opening edge 144 and the right arm opening edge 150-1.

Similarly, as an example, a front portion of the left releasable closure 104-2 includes one or more releasable fasteners 154 located proximate to and extending along the left-front shoulder edge 138-2 and the left-front sleeve edge 146-2 between the front neck opening edge 142 and the left arm opening edge 150-2. A back portion of the left releasable closure 104-2 includes one or more releasable fasteners 154 located proximate to and extending along the left-back shoulder edge 140-2 and the left-back sleeve edge 148-2 between the back neck opening edge 144 and the left arm opening edge 150-2.

In an example, and as illustrated in FIG. 5, a plurality of releasable fasteners 154 are disposed discontinuously along the opposed edges of the openable seams 102. As an example, adjacent ones of the releasable fasteners 154 may be spaced apart from each other (e.g., at regular or irregular intervals). In another example, and as illustrated in FIG. 6, one releasable fastener 154 extends continuously along the opposed edges of the openable seams 102.

The releasable fasteners 154 may include, or be formed from, any fastening mechanism or device that is simple to use, operate and manipulate with one arm. Preferably, the releasable fasteners 154 require only some small degree of pressure to secure together. The releasable fasteners 154 are adapted to be reusable many times over the life of the garment 100. The releasable fasteners 154 may be joined to the fabric material of the garment 100 through various material joining techniques known to those of ordinary skill in the art, such as sewing, gluing, fastening or any other means of joining materials together.

In an example, the releasable fasteners 154 include, or are formed from, mating portions of a hook and loop fastener or mating sections of a hoop and loop material (e.g., Velcro™). In this example, the releasable fasteners 154 are easily secured together upon general alignment and engagement of opposed, mating and complementary sections of the hook and loop material. As an example, a plurality of sections of the hook and loop material is secured to appropriate surfaces of the garment 100 along the opposed front edge 156 and back edge 158 of the openable seam 102, as illustrated in FIG. 5. As another example, continuous, elongated strips of the hook and loop material are secured to appropriate surfaces of the garment 100 along the opposed front edge 156 and back edge 158 of the openable seam 102, as illustrated in FIG. 6. The sections or strips of the hook and loop material may have various sizes and shapes depending upon the size and style of the garment 100.

In another example, the releasable fasteners 154 include, or are formed from, mating portions of a magnetic fastener or mating sections of a magnetic material. In this example, the releasable fasteners 154 are self-secured together upon general alignment and close proximity of opposed, mating and magnetically opposite sections of the magnetic material. As an example, a plurality of sections of the magnetic material (e.g., magnets) is secured to appropriate surfaces of the garment 100 along the opposed front edge 156 and back edge 158 of the openable seam 102, as illustrated in FIG. 5. As another example, continuous, elongated strips of the magnetic material (e.g., magnetic tape) are secured to appropriate surfaces of the garment 100 along the opposed front edge 156 and back edge 158 of the openable seam 102, as illustrated in FIG. 6.

In other examples, the releasable fasteners 154 may include various other types of fasteners configured to hold material together, such as zippers, snaps, buttons and the like.

FIG. 7 illustrates an example of the garment 100 in a substantially closed configuration (e.g., disposition or arrangement). In FIG. 7, the right openable seam 102-1 and the left openable seam 102-2 are shown in a loose relationship in order to more clearly show various edges and a right (e.g., first) line of connection 132-1 and a left (e.g., second) line of connection 132-2 of the garment 100.

Referring to FIG. 7, and with reference to FIGS. 5 and 6, with the garment 100 disposed in the closed configuration and the releasable closures 104 engaged to secure the openable seams 102 together, the right-front shoulder edge 138-1 and the right-back shoulder edge 140-1 (FIGS. 5 and 6) come together to form a right shoulder region 134-1 of the torso section 108 of the garment 100. The right-front sleeve edge 146-1 and the right-back sleeve edge 148-1 (FIGS. 5 and 6) come together to form the right sleeve 110-1 of the garment 100. The left-front shoulder edge 138-2 and the left-back shoulder edge 140-2 (FIGS. 5 and 6) come together to form a left shoulder region 134-2 of the torso section 108 of the garment 100. The left-front sleeve edge 146-2 and the left-back sleeve edge 148-2 (FIGS. 5 and 6) come together to form the left sleeve 110-2 of the garment 100.

As partially illustrated in FIG. 7, the material at the upper end 112 of the front 116 and the back 118 of the torso section 108 and the sleeves 110 proximate to the front edge 156 and the back edge 158 of the openable seam 102 overlap in order for the releasable closures 104 (e.g., the opposed releasable fasteners 154) to come together and connect.

In the illustrative examples, the releasable fasteners 154 associated with a front portion of the of the right openable seam 102-1 and the left openable seam 102-1 (e.g., proximate to the right-front edge 156-1 and the left-front edge 156-2) are located on the inside of the front 116 of the garment 100. The releasable fasteners 154 associated with a back portion of the of the right openable seam 102-1 and the left openable seam 102-1 (e.g., proximate to the right-back edge 158-1 and the left-back edge 158-2) are located on the outside of the back 118 of the garment 100. However, in other examples (not illustrated), this configuration may be reversed. As an example, the releasable fasteners 154 associated with the front portion of the of the right openable seam 102-1 and the left openable seam 102-1 (e.g., proximate to the right-front edge 156-1 and the left-front edge 156-2) are located on the outside of the front 116 of the garment 100. The releasable fasteners 154 associated with the back portion of the of the right openable seam 102-1 and the left openable seam 102-1 (e.g., proximate to the right-back edge 158-1 and the left-back edge 158-2) are located on the inside of the back 118 of the garment 100. As will be described in more detail below, the inside and outside locations of the releasable fasteners 154 may depend, at least in part, on the configuration, location and operation of the disclosed closing feature 106 of the garment 100.

Referring now generally to FIGS. 2, 4-6 and 8-11, the closing feature 106 is configured to engage the upper end 112 of the front 116 and the back 118 of the garment 100 in order to draw the opposed front edge 156 and rear edge 158 of the openable seam 102 together and engage the releasable closure 104. As expressed above, the closing feature 106 is located on the same side of the garment 100 as the fully functional arm of the wearer.

In the illustrative examples of FIGS. 2, 4-6, 10 and 11, the closing feature 106 is located on the left side of the garment 100. In this example, the garment 100 is particularly useful where the left arm of the wearer is the fully functional arm and the right arm is the functionally limited arm. In the illustrative example of FIG. 8, the closing feature 106 is located on the right side of the garment 100. In this example, the garment 100 is particularly useful where the right arm of the wearer is the fully functional arm and the left arm is the functionally limited arm. In the illustrative example of FIG. 9, the closing feature 106 is located on both the right side and the left side of the garment 100, identified as a right (e.g., first) closing feature 106-1 and a left (e.g., second) closing feature 106-2. In this example, the garment 100 may be particularly useful regardless of which arm of the wearer has limited functionality.

In an example, the closing feature 106 includes at least one pull strap 160 and at least one strap engagement feature 152. A secured (e.g., first) end 162 of the pull strap 160 is connected or otherwise joined to one of the front 116 or the back 118 of the garment 100. An opposed free end 164 of the pull strap 160 engages an opposing one of the front 116 or the back 118 of the garment 100. The strap engagement feature 152 is joined to an opposing one of the front 116 or the back 118 of the garment 100 to engage and retain the pull strap 160 when enclosing the openable seam 102. During manual manipulation of the closing feature 106, a pulling force is applied to the pull strap 160 to bring the upper end 112 of the front 116 and the back 118 together and enclose the shoulder region 134 of the torso section 108 around the shoulder of the wearer and enclose the sleeve 110 around the arm of the wearer.

As an example, the secured end 162 of the pull strap 160 is affixed (e.g., permanently joined or integral to) the material of the garment 100. In this example, the secured end 162 of the pull strap 160 may be joined to the fabric material of the garment 100 through various material joining techniques known to those of ordinary skill in the art, such as sewing, gluing, fastening or any other means of joining materials together. As another example, the secured end 162 of the pull strap 160 is removably connected the material of the garment 100. In this example, the secured end 162 of the pull strap 160 may be removably or releasably joined to the fabric material of the garment 100 through various material joining techniques known to those of ordinary skill in the art.

In an example, the pull strap 160 includes, or is formed from, a continuous, elongated strip of material. As an example, the material making up the pull strap 160 may be substantially the same as the material making up the torso section 108 and/or sleeves 110 of the garment 100. As another example, the material making up the pull strap 160 may be different than the material making up the torso section 108 and/or sleeves 110 of the garment 100.

In another example, the pull strap 160 includes, or is formed from, a continuous, elongated cord of material (e.g., a pull cord).

Referring to FIGS. 2, 4-6 and 8-10, in an example, the closing feature 106 includes at least one pull strap 160. In these examples, at least one pull strap 160 is located at the shoulder region 134 of the torso section 108 of the garment 100 on one side of the garment 100.

As an example, and as illustrated in FIGS. 5, 6, 8 and 9, the secured end 162 of the pull strap 160 is joined to the front 116 of the garment 100 along the front shoulder edge 138 and the opposed free end 164 of the pull strap 160 engages the opposing back 118 of the garment 100 along the back shoulder edge 140.

Figure 10:
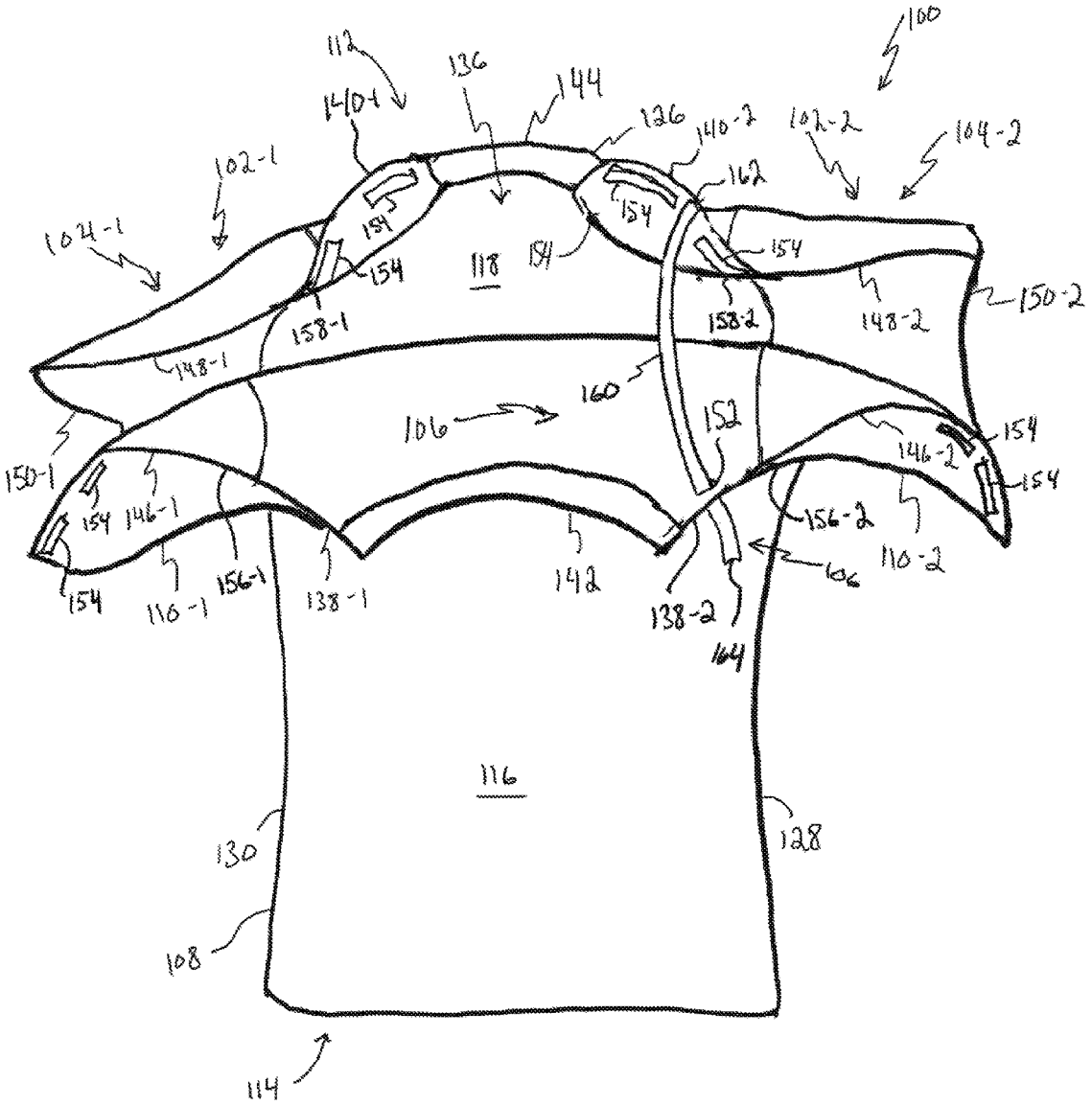
FIG. 10 is a schematic front view of another example of the disclosed garment shown in an open disposition.

As another example, and as illustrated in FIG. 10, the secured end 162 of the pull strap 160 is joined to the back 118 of the garment 100 along the back shoulder edge 140 and the opposed free end 164 of the pull strap 160 engages the opposing front 116 of the garment 100 along the front shoulder edge 138.

Figure 11:
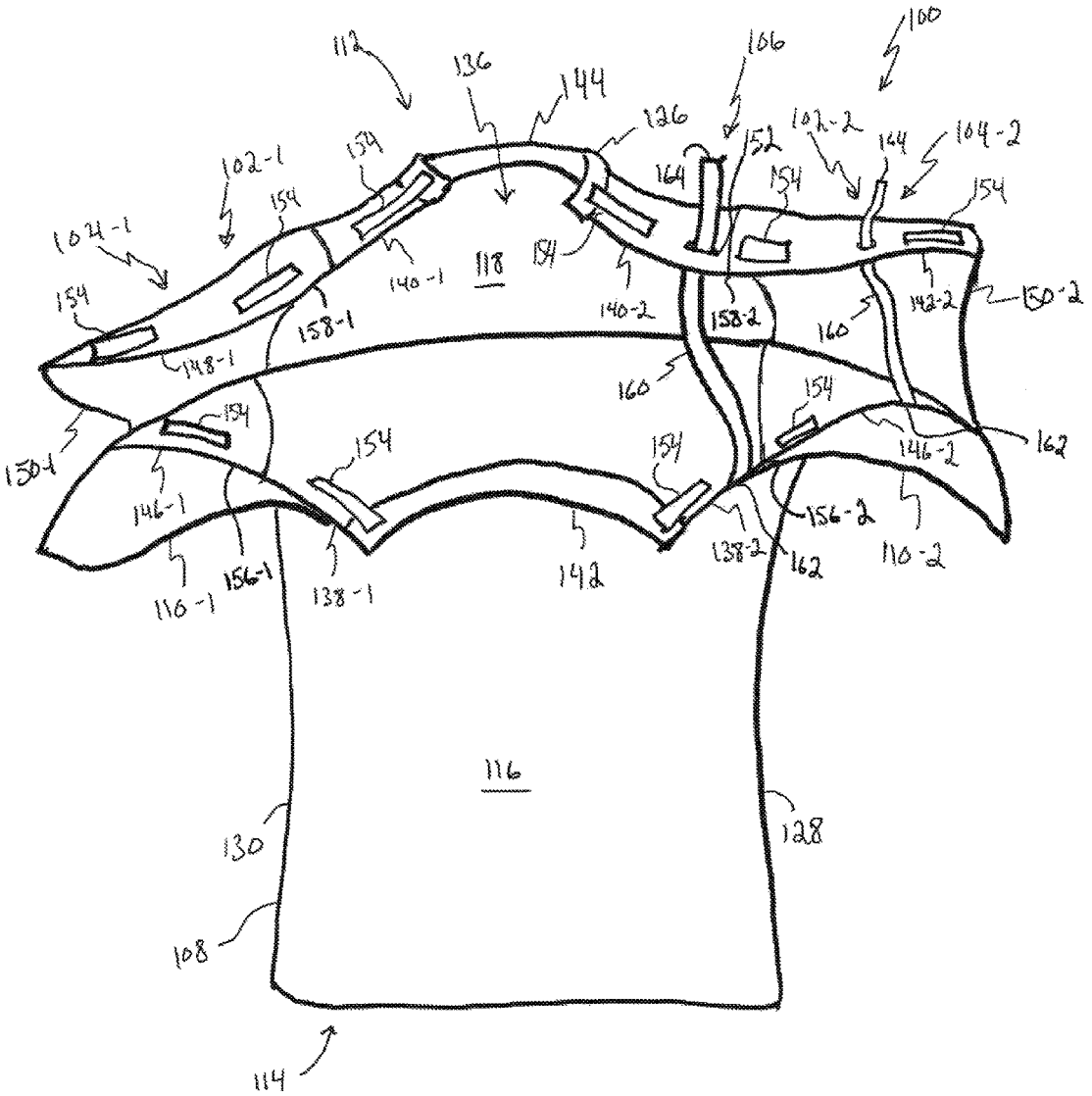
FIG. 11 is a schematic front view of another example of the disclosed garment shown in an open disposition.

Referring to FIG. 11, in another example, the closing feature 106 includes more than one (e.g., two) pull straps 160. In this example, at least one pull strap 160 is located at the shoulder region 134 of the torso section 108 of the garment 100 and at least one pull strap 160 is located at the sleeve 110 of the garment 100.

As an example, and as illustrated in FIG. 11, the secured end 162 of one (e.g., a first) pull strap 160 is joined to the front 116 of the garment 100 along the front shoulder edge 138 and the opposed free end 164 of the first pull strap 160 engages the opposing back 118 of the garment 100 along the back shoulder edge 140. The secured end 162 of another one (e.g., a second) pull strap 160 is joined to the front 116 of the sleeve 110 along the front sleeve edge 146 and the opposed free end 164 of the second pull strap 160 engages the opposing back 118 of the sleeve 110 along the back sleeve edge 148.

As another example (not illustrated), the secured end 162 of one (e.g., the first) pull strap 160 is joined to the back 118 of the garment 100 along the back shoulder edge 140 and the opposed free end 164 of the first pull strap 160 engages the opposing front 116 of the garment 100 along the front shoulder edge 138. The secured end 162 of another one (e.g., the second) pull strap 160 is joined to the back 118 of the sleeve 110 along the back sleeve edge 148 and the opposed free end 164 of the second pull strap 160 engages the opposing front 116 of the sleeve 110 along the front sleeve edge 146.

The number of pull straps 160 located at the shoulder region 134 of the torso section 108 and/or the number of pull straps 160 located at the sleeves 110 may vary depending upon the size and style of the garment 100 without departing from the scope of the present disclosure.

Referring to FIGS. 5, 6, 8, 9 and 11, in an example, the secured end 162 of the pull strap 160 is joined to the inside surface of the front 116 of the garment 100, for example, proximate to (e.g., at or near) the front edge 156 of the openable seam 102. The body of the pull strap 160 engages the back 118 of the garment 100 with the free end 164 of the pull strap 160 extending outward and away from the back 118 of the garment 100. A pulling force applied to the free end 164 of the pull strap 160 draws the front 116 and the back 118 of the garment 100 together (e.g., pulls the front 116 toward the back 118) to enclose the openable seam 102 forming the line of connection 132 (FIG. 7) of the garment 100.

In this example, releasable fasteners 154 are located on the inside of the front 116 and the outside of the back 118 of the garment 100. The configuration allows the releasable fasteners 154 associated with the front 116 (e.g., front releasable fasteners 154) to self align with and engage the releasable fasteners 154 associated with the back 118 (e.g., back releasable fasteners 154) as the front 116 and the back 118 are drawn together. In this example, and as illustrated in FIG. 7, a portion of the material of the front 116 proximate to the front edge 156 (e.g., having the front releasable fasteners 154) overlaps and is positioned on top of a portion of the material of the back 118 proximate to the back edge 158 (e.g., having the back releasable fasteners 154).

Referring to FIG. 10, in another example, the secured end 162 of the pull strap 160 is joined to the inside surface of the back 118 of the garment 100, for example, proximate to (e.g., at or near) the back edge 158 of the openable seam 102. The body of the pull strap 160 engages the front 116 of the garment 100 with the free end 164 of the pull strap 160 extending outward and away from the front 116 of the garment 100. A pulling force applied to the free end 164 of the pull strap 160 draws the front 116 and the back 118 of the garment 100 together (e.g., pulls the back 118 toward the front 116) to enclose the openable seam 102 forming the line of connection 132 (FIG. 7) of the garment 100.

In this example, releasable fasteners 154 are located on the outside of the front 116 and the inside of the back 118 of the garment 100. The configuration allows the releasable fasteners 154 associated with the back 118 (e.g., back releasable fasteners 154) to self align with and engage the releasable fasteners 154 associated with the front 116 (e.g., front releasable fasteners 154) as the back 118 and the front 116 are drawn together. In this example, a portion of the material of the back 118 proximate to the back edge 158 (e.g., having the back releasable fasteners 154) overlaps and is positioned on top of a portion of the material of the front 116 proximate to the front edge 156 (e.g., having the front releasable fasteners 154).

Following engagement of the releasable fasteners 154 of the releasable closure 104 and enclosure of the openable seam 102, the pull strap 160 may hang from the shoulder region 134 of the garment 100. In examples of the garment 100 with the pull strap 160 joined to the front 116 and in engagement with the back 118 (e.g., FIGS. 1-9 and 11), the body of the pull strap 160 may hang along the back 118 of the garment 100. In examples of the garment 100 with the pull strap 160 joined to the back 118 and in engagement with the front 116 (e.g., FIG. 10), the body of the pull strap 160 may hang along the front 116 of the garment 100.

Referring to FIG. 4, in an example, the free end 164 of the pull strap 160 may include one (e.g., a first) releasable strap fastener 168. Another one (e.g., a second) releasable strap fastener 168 may be joined to the outside of the garment 100 (e.g., to the front 116 or the back 118 of the torso section 108 and/or the sleeve 110). Engagement of the releasable strap fastener 168 secures the pull strap 160 (e.g., the free end 164) to the garment 100 and prevents free movement of the pull strap 160.

As an example, the releasable strap fasteners 168 may include, or are formed from, mating portions of a hook and loop fastener or mating sections of a hoop and loop material (e.g., Velcro™). In this example, the releasable strap fasteners 168 are easily secured together upon general alignment and engagement of opposed, mating and complementary sections of the hook and loop material.

As another example, the releasable strap fasteners 168 may include, or are formed from, mating portions of a magnetic fastener or mating sections of a magnetic material. In this example, the releasable strap fasteners 168 are self-secured together upon general alignment and close proximity of opposed, mating and magnetically opposite sections of the magnetic material.

In another example (not illustrated), the pull strap 160 may be weighted at the free end 164. The weighted free end 164 of the pull strap 160 limits free movement of the pull strap 160.

Referring to FIGS. 12-15, in various examples, the disclosed garment 100 may include different configurations, constructions and arrangements of the closing feature 106, for example, depending upon the clothing style and overall appearance of the garment 100. The examples of the garment 100 illustrated in FIGS. 12-15 show the garment 100 with the pull strap 160 joined to the front 116 of the garment 108 and for engagement with the back 118 of the garment 100 to draw the front 116 and the back 118 together and to enclose the openable seam 102 by engagement of the releasable closure 104 (e.g., of the releasable fasteners 154). However, in other examples (not illustrated), this arrangement may be reversed with the pull strap 160 joined to the back 118 of the garment 108 and for engagement with the front 116 of the garment 100 to draw the front 116 and the back 118 together and to enclose the openable seam 102 by engagement of the releasable closure 104 (e.g., of the releasable fasteners 154). As such, and for the purpose of brevity, additional examples of the garment 100 associated with FIGS. 12-15 and having the reverse configuration are not explicitly illustrated.

Figure 12:
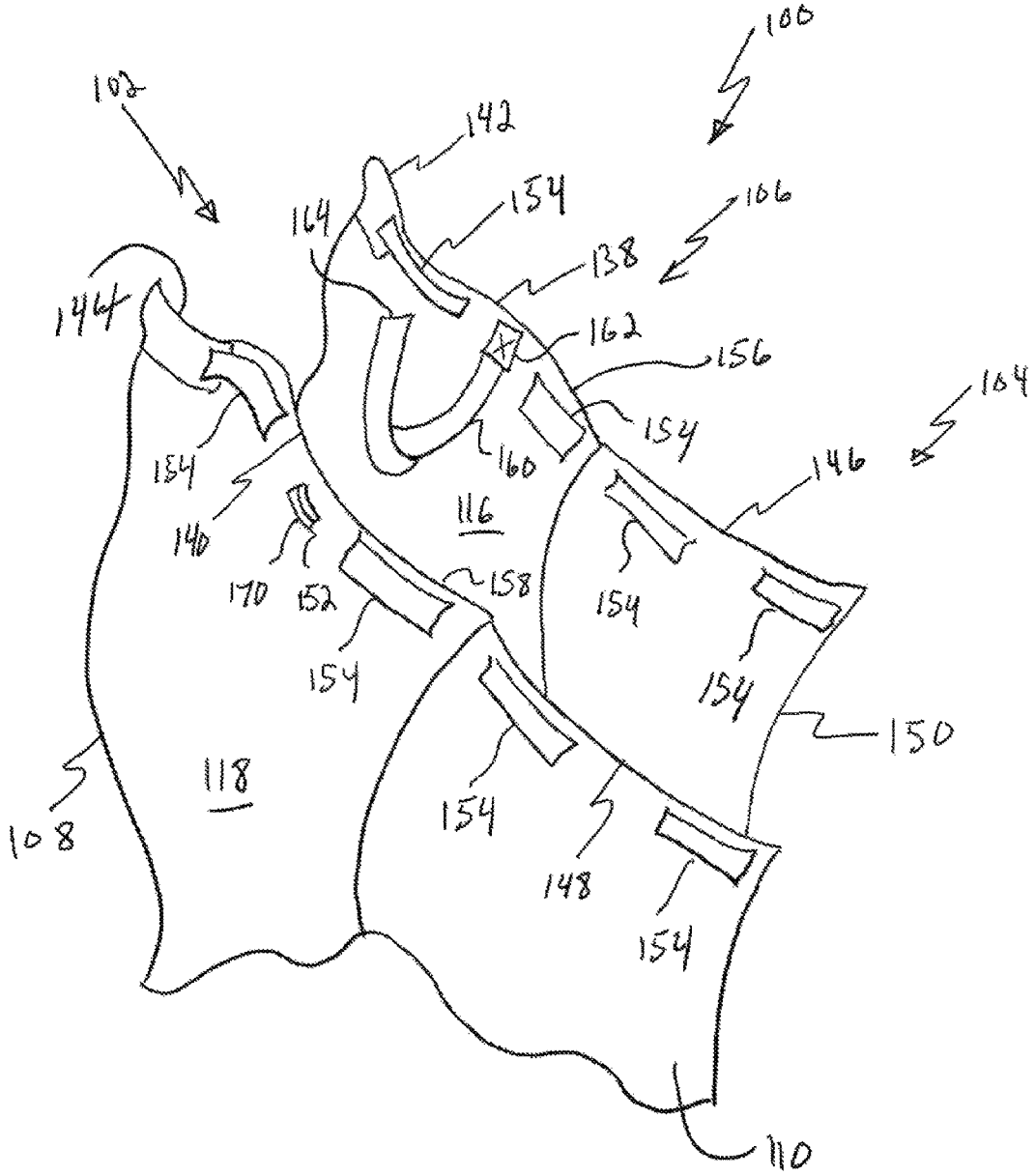
FIG. 12 is a schematic fragmentary back view of another example of the disclosed garment shown in an open disposition.

Referring to FIG. 12, in an example, the secured end 162 of the pull strap 160 is affixed (e.g., permanently joined or integral to) the inside of the front 116 of the garment 100, for example, proximate to the front edge 156 of the openable seam 102. In this example, the secured end 162 of the pull strap 160 may be joined to the fabric material of the front 116 of the garment 100 through various material joining techniques known to those of ordinary skill in the art, such as sewing, gluing, fastening or any other means of joining materials together.

In an example, the strap engagement feature 152 includes a strap aperture 170 (e.g., a hole or slot). With the with the pull strap 160 joined to the front 116 of the garment 100, the strap aperture 170 is formed through the back 118 of the garment 110, for example, proximate to the back edge 158 of the openable seam 102. In this example, when enclosing the openable seam 102, the free end 164 of the pull strap 160 is passed through the strap aperture 170 from the inside of the back 118 to the outside of the back 118 and the pulling force is applied to the pull strap 160 to draw the front 116 and the back 118 together.

In another example (not illustrated), the secured end 162 of the pull strap 160 is affixed (e.g., permanently joined or integral to) the inside of the back 118 of the garment 100, for example, proximate to the back edge 158 of the openable seam 102. In this example, the secured end 162 of the pull strap 160 may be joined to the fabric material of the back 118 of the garment 100 through various material joining techniques known to those of ordinary skill in the art, such as sewing, gluing, fastening or any other means of joining materials together.

In another example (not illustrated), with the pull strap 160 joined to the back 118 of the garment 100, the strap aperture 170 (e.g., a hole or slot) is formed through the front 116 of the garment 110, for example, proximate to the front edge 156 of the openable seam 102. In this example, when enclosing the openable seam 102, the free end 164 of the pull strap 160 is passed through the strap aperture 170 from the inside of the front 116 to the outside of the front 116 and the pulling force is applied to the pull strap 160 to draw the back 118 and the front 116 together.

Figure 13:
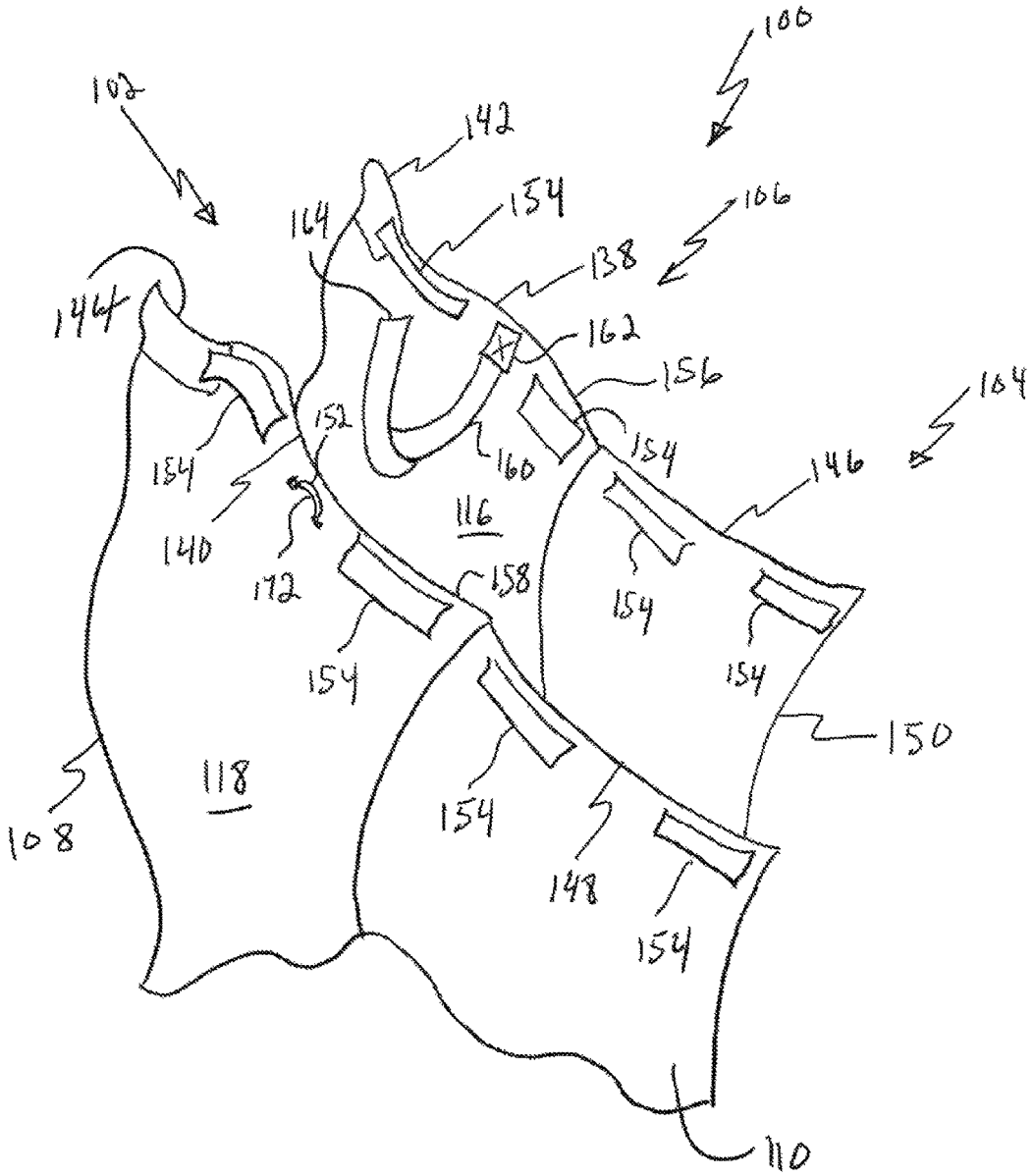
FIG. 13 is a schematic fragmentary back view of another example of the disclosed garment shown in an open disposition.

Referring to FIG. 13, in another example, the strap engagement feature 152 includes a strap loop 172. With the pull strap 160 joined to the front 116 of the garment 100, the strap loop 172 is joined to the outside of the back 118 of the garment 110, for example, proximate to the back edge 158 of the openable seam 102. In this example, when enclosing the openable seam 102, the free end 164 of the pull strap 160 is passed through the strap loop 172 and the pulling force is applied to the pull strap 160 to draw the front 116 and the back 118 together.

In another example (not illustrated), with the pull strap 160 joined to the back 118 of the garment 100, the strap loop 172 is joined to the outside of the front 116 of the garment 110, for example, proximate to the front edge 156 of the openable seam 102. In this example, when enclosing the openable seam 102, the free end 164 of the pull strap 160 is passed through the strap loop 172 and the pulling force is applied to the pull strap 160 to draw the back 118 and the front 116 together.

Figure 14:
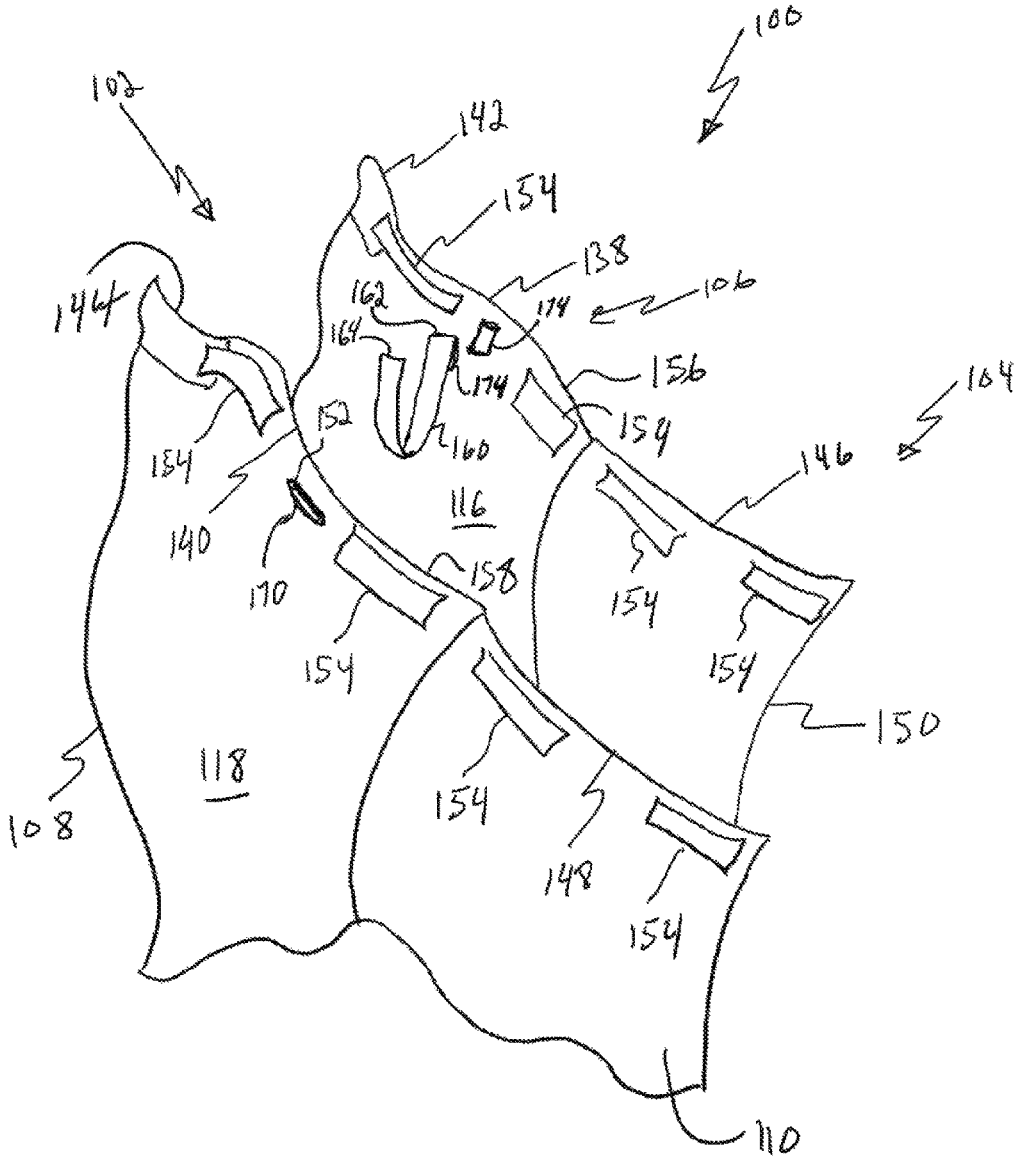
FIG. 14 is a schematic fragmentary back view of another example of the disclosed garment shown in an open disposition.

Referring to FIG. 14, in another example, the secured end 162 of the pull strap 160 is releasably joined (e.g., removably connected) to the inside of the front 116 of the garment 100, for example, proximate to the front edge 156 of the openable seam 102. In this example, the secured end 162 of the pull strap 160 may be removably or releasably joined to the fabric material of the front 116 of the garment 100 through various material joining techniques known to those of ordinary skill in the art.

As an example, the secured end 162 of the pull strap 160 may include one (e.g., a first) releasable strap fastener 174. Another one (e.g., a second) releasable strap fastener 174 may be joined to the inside of the front 116 of the garment 100. Engagement of the releasable strap fastener 174 secures the pull strap 160 (e.g., the secured end 162) to the garment 100.

In another example (not illustrated), the secured end 162 of the pull strap 160 is releasably joined (e.g., removably connected) to the inside of the back 118 of the garment 100, for example, proximate to the back edge 158 of the openable seam 102. In this example, the secured end 162 of the pull strap 160 may be removably or releasably joined to the fabric material of the back 118 of the garment 100 through various material joining techniques known to those of ordinary skill in the art.

As an example, the secured end 162 of the pull strap 160 may include one (e.g., the first) releasable strap fastener 174. Another one (e.g., the second) releasable strap fastener 174 may be joined to the inside of the back 118 of the garment 100. Engagement of the releasable strap fastener 174 secures the pull strap 160 (e.g., the secured end 162) to the garment 100.

The examples of a releasable pull strap 160 may be used with any of the disclosed variations of the strap engagement feature 152 (e.g., the strap aperture 170, the strap loop 172 and the like), for example, as illustrated in FIGS. 12 and 13.

The releasable strap fasteners 172 may include, or be formed from, any fastening mechanism or device that is simple to use, operate and manipulate, particularly, with one arm. The releasable strap fasteners 172 are adapted to be reusable many times over the life of the garment 100. In an example, the releasable strap fasteners 172 require only some small degree of pressure to secure together. As examples, the releasable strap fasteners 172 may include mating portions of a hook and loop fastener or mating portions of a magnetic fastener. As other examples, the releasable strap fasteners 172 may include various other types of fasteners configured to hold material together, such as snaps, buttons and the like.

In another example, the releasable strap fasteners 172 may release in response to a sufficient pulling force applied to the pull strap 160. As an example, following manipulation of the pull strap 160 and application of a first pulling force to draw the front 116 and the back 118 together to engage the releasable closure 104 and enclose the openable seam 102, an additional second pulling force (e.g., a jerk) may release the releasable strap fasteners 172 such that the pull strap 160 may be completely withdrawn through the strap engagement feature 152 (e.g., the strap aperture 170 or the strap loop 172) and removed from the garment 100.

Figure 15:
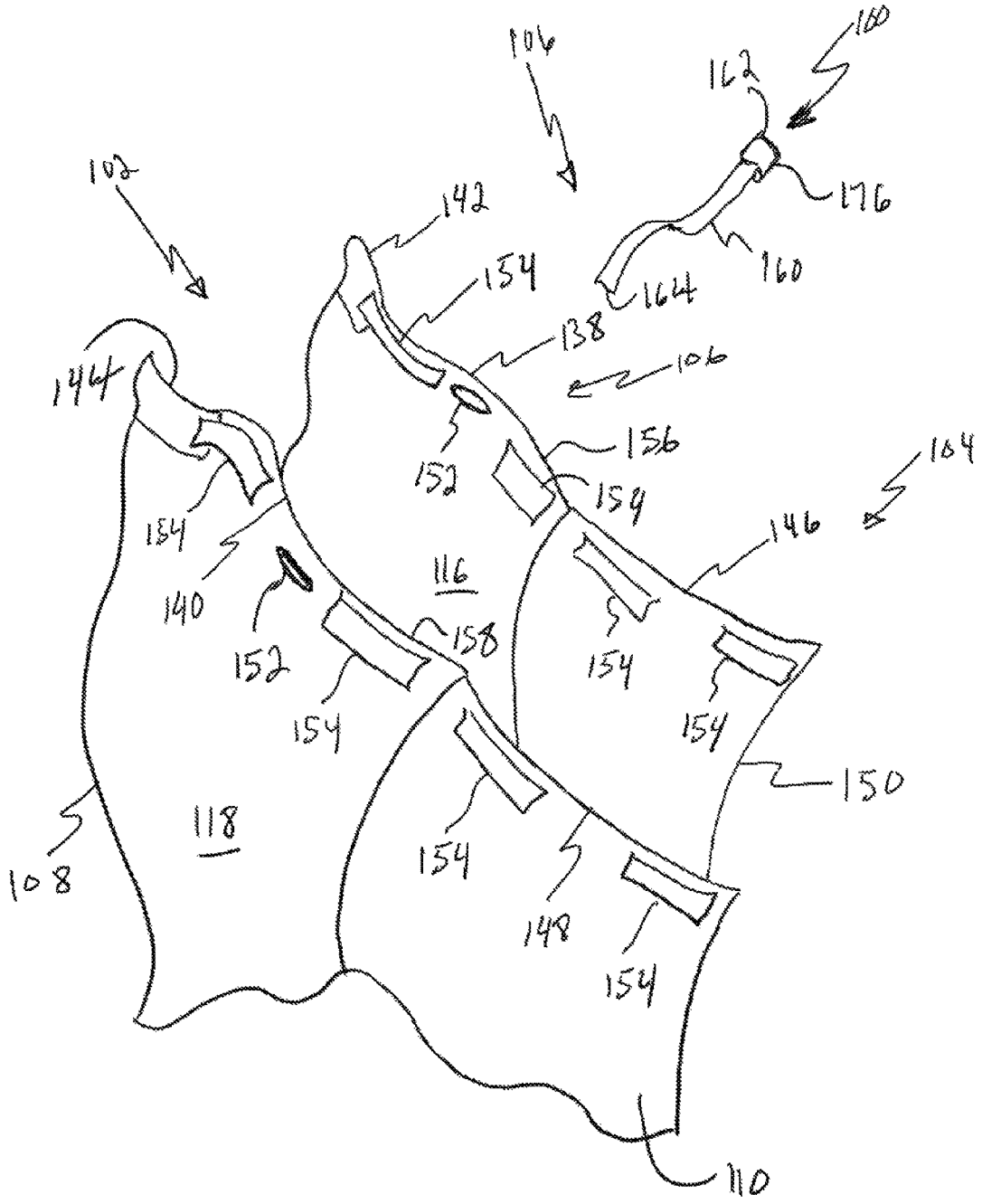
FIG. 15 is a schematic fragmentary back view of another example of the disclosed garment shown in an open disposition.

Referring to FIG. 15, in an example, the closing feature 106 includes one (e.g., a first) strap engagement feature 152 disposed on the back 118 of the garment 100 (e.g., a back strap engagement feature 152) and another one (e.g., second) strap engagement feature 152 disposed on the front 116 of the garment 100 (e.g., a front strap engagement feature 152). As an example, and as illustrated in FIG. 15, the garment 100 includes a back strap aperture 170 formed through the back 118 of the garment 100 and a front strap aperture 170 formed through the front 116 of the garment 100. As another example (not illustrated), the garment 100 includes a back strap loop 172 joined to an inside or an outside of the back 118 of the garment 100 and a front strap loop 172 joined to an inside or an outside of the front 116 of the garment 100.

In this example, the pull strap 160 includes a stop 176 connected to or formed at the secured end 162 of the pull strap 160. The free end 164 of the pull strap 160 engages both the front strap engagement feature 152 and the back strap engagement feature 152 (e.g., passes through the front and back strap apertures 170 or the front and back strap loops 172). The stop 176 is configured to prevent the pull strap 160 from completely passing through the pair of front and back strap engagement features 152. As an example, the stop 176 is sized larger than the strap apertures 170 or the strap loops 172.

In this example, the pull strap 160 may pass from the front 116 to the back 118 or from the back 118 to the front 116, for example, depending upon the clothing style of the garment 100 and/or the configuration or arrangement of the releasable fasteners 154. During manipulation of the pull strap 160 and application of a first pulling force to pass the pull strap 160 through the pair of strap engagement features 152, the stop 176 engages the outside of the garment 100 (e.g., the outside of the front 116 or the back 118 depending upon the direction of the pull strap 160) to draw the front 116 and the back 118 together and to engage the releasable closure 104 and enclose the openable seam 102.

Following manipulation of the pull strap 160 (e.g., application of the first pulling force applied to the free end 164 of the pull strap 160) to draw the front 116 and the back 118 together and engage the releasable closure 104 to enclose the openable seam 102, a second pulling force, in a direction opposite the first pulling force, may be applied to the secured end 162 (e.g., the stop 176) of the pull strap 160 to completely withdraw the pull strap 160 from the pair of strap engagement features 152 (e.g., the strap apertures 170 or the strap loops 172) and remove the pull strap 160 from the garment 100.

The illustrative examples presented herein disclose the garment 100 for wear by a person having one functionally limited arm and one fully functional arm. The garment 100 is configured for ease of donning and for practical and convenient manipulation of the openable seam 102 on the side associated with the fully functional arm using the closing feature 106. Furthermore, also disclosed is a method for making the disclosed garment 100 and a method for utilizing the disclosed garment 100.

In an example, the disclosed method for making the garment 100 includes providing the front 116 and the back 118 forming the torso section 108 of the garment 100 for covering the chest and back regions of the wearer. The method also includes forming the openable seam 102 separating the front 116 and the back 118. In examples where the garment 100 includes sleeves 110 joined to the torso section 108, the openable seam 102 is formed along opposing (e.g., right and left) shoulder regions 134 of the torso section 108 and along opposing (e.g., right and left) sleeves 110 of the garment 100. In examples where the garment 100 is sleeveless, the openable seam 102 is formed along opposing (e.g., right and left) shoulder regions 134 of the torso section 108. The method also includes providing the releasable closure 104 (e.g., cooperating portions of front and back releasable fasteners 154) located along the openable seam 102 to releasably secure the openable seam together. The method also includes providing the closing feature 106 (e.g., at least one pull strap 160 and strap engaging feature 152) located proximate to the openable seam 102 to draw the front 116 and the back 118 together and engage the releasable closure 104 to enclose the openable seam 102 along one of the shoulder regions 134 and, optionally, one of the sleeves 110 associated with the fully functional arm.

In an example, the disclosed method for utilizing the garment 100 includes separating the front 116 and the back 118 along the openable seam 102 to open opposed shoulder regions 134 and, optionally, sleeves 110, and define the upper torso opening 136. The garment 100 may be donned by pulling the torso section 108 down from over the head of the wearer or by pulling the torso section 108 up from the lower body of the wearer to position the garment 100 to cover the upper body of the wearer. The method also includes manually enclosing the openable seam 102 and engaging the releasable closure 104 on the side of the garment 100 associated with the functionally limited arm using the fully functional arm. The fully functional arm ordinarily has the range of motion sufficient to bring the front 116 and the back 118 together, enclose the openable seam 102 together and secure the openable seam 102 in the closed disposition by engaging the releasable closure 104 on the side of the garment 100 associated with the functionally limited arm (i.e., opposite the fully functional arm). However, the fully functional arm may lack the range of motion sufficient to bring the front 116 and the back 118 together, enclose the openable seam 102 together and secure the openable seam 102 in the closed disposition by engaging the releasable closure 104 on the side of the garment 100 associated with the fully functional arm. Therefore, the method also includes manually enclosing the openable seam 102 and engaging the releasable closure 104 on the side of the garment 100 associated with the fully functional arm by manipulating the closing feature 106 using the fully functional arm. The fully functional arm ordinarily has the range of motion sufficient to engage the pull strap 160 with the strap engagement feature 152 (e.g., to pass the pull strap 160 through the strap aperture 170 or the strap loop 172) and to apply the pulling force to the pull strap 160 sufficient to draw the front 116 and the back 118 together. The pulling force may be applied in a generally forward direction, a generally upward direction, a generally rearward direction or a combination thereof, for example, depending upon the configuration and locations of the pull strap 160 and the strap engagement feature 152 to draw the front 116 and the back 118 together. Drawing the front 116 and the back 118 together, aligns and engages the releasable closure 104 to secure the openable seam 102 together. Thus, the wearer with the use of only one, fully functional arm may accomplish donning the garment 100 without the assistance of others.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example and without limitation, two of item A, one of item B, and ten of item C; four of item B and seven of item C; or some other suitable combination.

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, and within less than 0.01% of the stated amount.

As used herein, the term "substantially" may include exactly and similar, which is to an extent that it may be perceived as being exact. For illustration purposes only and not as a limiting example, the term "substantially" may be quantified as a variance of +/−5% from the exact or actual. For example, the phrase "A is substantially the same as B" may encompass embodiments where A is exactly the same as B, or where A may be within a variance of +/−5%, for example of a value, of B, or vice versa.

As used herein, the terms "partially" or "at least a portion of" may represent an amount of a whole that includes an amount of the whole that may include the whole. For example, the term "a portion of" may refer to an amount that is greater than 0.01% of, greater than 0.1% of, greater than 1% of, greater than 10% of, greater than 20% of, greater than 30% of, greater than 40% of, greater than 50% of, greater than 60%, greater than 70% of, greater than 80% of, greater than 90% of, greater than 95% of, greater than 99% of, and 100% of the whole.

Although various embodiments of the disclosed apparatus, systems and methods have been shown and described, modifications may occur to those skilled in the art upon reading the specification. The present application includes such modifications and is limited only by the scope of the claims.

What is claimed is:

1. A garment comprising:

a front and a back;

an openable seam separating said front and said back such that said front comprises a front edge of said openable seam and said back comprises a back edge of said openable seam;

a releasable closure to secure said openable seam together, said releasable closure comprising:

at least one front magnetic fastener located on said front proximate to said front edge of said openable seam;

at least one back magnetic fastener located on said back proximate to said back edge of said openable seam; and a closing feature to draw said front and said back together and to position said front magnetic fastener and said back magnetic fastener in close proximity to each other, said closing feature comprising:

a pull strap joined to one of said front or said back; and a strap engagement feature disposed on an opposing one of said front or said back opposite said pull strap; and wherein said pull strap engages said strap engagement feature such that, when engaged with said strap engagement feature, an application of a pulling force on only said pull strap draws said front edge of said openable seam and said back edge of said openable seam together such that said at least one front magnetic fastener and said at least one back magnetic fastener are positioned in close proximity to each other such that attraction between said at least one front magnetic fastener and said at least one back magnetic fastener closes said openable seam.

2. The garment of claim 1 wherein said at least one front magnetic fastener and said at least one back magnetic fastener comprise one of:

cooperating continuous magnetic strips;

a discontinuous plurality of cooperating magnetic segments; or a plurality of magnetic snaps.

3. The garment of claim 1 wherein said strap engagement feature comprises one of:

a strap aperture formed through said opposing one of said front or said back; or a strap loop joined to said opposing one of said front or said back.

4. The garment of claim 1 wherein said pull strap comprises a secured end that is affixed to said one of said front or said back and a free end, opposite said secured end, that engages that strap engagement feature.

5. The garment of claim 1 wherein said pull strap comprises a secured end that is removably coupled to said one of said front or said back and a free end, opposite said secured end, that engages that strap engagement feature.

6. The garment of claim 1 wherein:

said front and said back form a torso section of said garment;

said openable seam extends along a shoulder region of said torso section; and at least one of said pull strap and at least one of said strap engagement feature are located along said shoulder region.

7. The garment of claim 1 wherein:

said front and said back further form a sleeve of said garment;

said openable seam further extends along said sleeve; and at least another one of said pull strap and at least another one of said strap engagement feature are located along said sleeve.

8. A garment for wear by a person having one functionally limited arm and one fully functional arm, said garment comprising:

a front and a back forming a torso section;

sleeves joined to said torso section an openable seam separating said front and said back along opposing shoulder regions of said torso section and along said sleeves;

a releasable closure to secure said openable seam together, said releasable closure comprising:

at least one front releasable fastener located on said front proximate to said openable seam;

at least one back releasable fastener located on said back proximate to said openable seam; and a closing feature to draw said front and said back together and to position said front releasable fastener and said back releasable fastener in close proximity to each other to close said openable seam along one of said sleeves associated with said fully functional arm; and wherein:

said front releasable fastener and said back releasable fastener are self-securing to close said openable seam when said front and said back are drawn together and said front releasable fastener and said back releasable fastener are positioned in close proximity to each other using only said fully functional arm;

a portion of said front and a portion of said back along said openable seam are positioned in an overlapping relationship; and said front releasable fastener and said back releasable fastener self-align so that said openable seam visually resembles a fixed seam.

9. The garment of claim 8 wherein:

said front comprises a front edge of said openable seam;

said back comprises a back edge of said openable seam;

said at least one front releasable fastener comprises at least one front magnetic fastener joined to said front proximate to said front edge of said openable seam; and said at least one back releasable fastener comprises at least one back magnetic fastener joined to back proximate to said back edge of said openable seam.

10. The garment of claim 9 wherein:

said closing feature comprises:

a pull strap joined to said front; and a strap engagement feature disposed on said back opposite said pull strap;

said pull strap engages said strap engagement feature; and when engaged with said strap engagement feature, application of a pulling force on only said pull strap using only said fully functional arm draws said front edge of said openable seam toward said back edge of said openable seam together to position said at least one front magnetic fastener and said at least one back magnetic fastener in close proximity to each other so that attraction between said at least one front magnetic fastener and said at least one back magnetic fastener closes said openable seam along said one of said shoulder regions associated with said fully functional arm.

11. The garment of claim 10 wherein said strap engagement feature comprises one of a strap aperture formed through said back or a strap loop joined to said back.

12. The garment of claim 9 wherein:

said closing feature comprises:

a pull strap joined to said back; and a strap engagement feature disposed on said front opposite said pull strap;

said pull strap engages said strap engagement feature; and when engaged with said strap engagement feature, application of a pulling force on only said pull strap using only said fully functional arm draws said back edge of said openable seam toward said front edge of said openable seam together to position said at least one back magnetic fastener and said at least one front magnetic fastener in close proximity to each other so that attraction between said at least one front magnetic fastener and said at least one back magnetic fastener closes said openable seam along said one of said shoulder regions associated with said fully functional arm.

13. The garment of claim 12 wherein said strap engagement feature comprises one of a strap aperture formed through said front or a strap loop joined to said front.

14. A method for making a garment for wear vy a person having one functionally limited arm and one fully functional arm, said method comprising:

providing a front and a back forming a torso section;

joining a sleeve to said torso section;

forming an openable seam separating said front and said back along opposing shoulder regions of said torso section and along said sleeve;

providing a releasable closure located along said openable seam to releasably secure said openable seam together, said releasable closure comprising:

at least one front releasable fastener located on said front proximate to said openable seam;

at least one back releasable fastener located on said back proximate to said openable seam; and providing a closing feature located proximate to said openable seam to draw said front and said back together and to position said front releasable fastener and said back releasable fastener in close proximity to each other upon application of a pulling force using only said fully functional arm, wherein said front releasable fastener and said back releasable fastener are self-securing to close said openable seam along said sleeve when said front and said back are drawn together and said front releasable fastener and said back releasable fastener are positioned in close proximity to each other using only said fully functional arm.

15. The garment of claim 1 wherein, when said front releasable fastener and said back releasable fastener are secured together:

a portion of said front and a portion of said back along said openable seam are positioned in an overlapping relationship; and said front releasable fastener and said back releasable fastener self-align so that said openable seam visually resembles a fixed seam.

16. The garment of claim 5 further comprising a first strap fastener coupled to said one of said front or said back, opposite said strap engagement feature, and wherein:

said pull strap further comprises a second strap fastener coupled to said secure end; and engagement of said first strap fastener and said second strap fastener removably couples said pull strap to said one of said front or said back.

17. The garment of claim 5 further comprising an additional strap engagement feature disposed on said one of said front or said back, opposite said strap engagement feature, and wherein:

said pull strap further comprises a stop disposed on said secured end; and engagement of said strap with said additional strap engagement feature removably couples said pull strap to said one of said front or said back; and said stop prevents said strap from being removed from said additional strap engagement feature during application of said pulling force on said pull strap to draw said front edge of said openable seam and said back edge of said openable seam together.

18. The garment of claim 1 further comprising at least one of cotton, polyester, silk and rayon.

19. The garment of claim 1 wherein:

said at least one front magnetic fastener comprises a plurality of front magnetic fasteners dispersed discontinuously along said front edge of said openable seam; and said at least one back magnetic fastener comprises a plurality of back magnetic fasteners dispersed discontinuousy along said back edge of said openable seam.

20. The garment of claim 8 wherein:

said torso section further comprises a neck opening;

each sleeve of said sleeves comprises an arm opening;

said at least one front magnetic fastener comprises a plurality of front magnetic fasteners;

said at least one back magnetic fastener comprises a plurality of back magnetic fasteners; and said plurality of front magnetic fasteners and said plurality of back magnetic fasteners form a line of connection extending from said neck opening of said torso section along at least one sleeve of said sleeves to an arm opening associated with said at least one sleeve.

* * * * *